US010700447B2

(12) United States Patent
Sato

(10) Patent No.: US 10,700,447 B2
(45) Date of Patent: Jun. 30, 2020

(54) TERMINAL WITH SEALING FEATURES FOR CRIMPING ON AN ELECTRIC WIRE

(71) Applicant: YAZAKI CORPORATION, Tokyo (JP)

(72) Inventor: Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/434,870

(22) Filed: Jun. 7, 2019

(65) Prior Publication Data

US 2020/0014126 A1 Jan. 9, 2020

(30) Foreign Application Priority Data

Jul. 9, 2018 (JP) ..... 2018-130102

(51) Int. Cl.

| | |
|---|---|
| ***H01R 4/18*** | (2006.01) |
| ***H01R 4/62*** | (2006.01) |
| ***H01R 43/055*** | (2006.01) |
| ***H01B 1/02*** | (2006.01) |
| ***H01R 43/16*** | (2006.01) |
| *H01R 4/10* | (2006.01) |
| *H01R 43/048* | (2006.01) |
| *H01R 4/20* | (2006.01) |
| *H01R 4/2495* | (2018.01) |

(52) U.S. Cl.

CPC ..... *H01R 4/185* (2013.01); *H01B 1/023* (2013.01); *H01R 4/188* (2013.01); *H01R 4/62* (2013.01); *H01R 43/055* (2013.01); *H01R 43/16* (2013.01); *H01R 4/10* (2013.01); *H01R 4/18* (2013.01); *H01R 4/20* (2013.01); *H01R 4/2495* (2013.01); *H01R 43/048* (2013.01)

(58) Field of Classification Search

CPC ..... H01R 4/185; H01R 43/048; H01R 4/18; H01R 4/20; H01R 4/10; H01R 4/2495

USPC ..... 439/877, 878, 879, 880, 881, 882

See application file for complete search history.

(56) References Cited

U.S. PATENT DOCUMENTS

| | | | | |
|---|---|---|---|---|
| 10,530,089 | B2 * | 1/2020 | Raab | H01R 13/432 |
| 2002/0058447 | A1 * | 5/2002 | Endo | H01R 43/0488 439/878 |
| 2013/0040511 | A1 * | 2/2013 | Takashima | H01R 4/185 439/882 |

(Continued)

FOREIGN PATENT DOCUMENTS

JP 5940198 B2 6/2016

*Primary Examiner* — Abdullah A Riyami
*Assistant Examiner* — Justin M Kratt
(74) *Attorney, Agent, or Firm* — Kenealy Vaidya LLP

(57) ABSTRACT

A terminal metal fitting for attaching to an electric wire. The terminal metal fitting has: a barrel portion; and a contact portion. The barrel portion has: a base-side crimping portion to be swaged to a covering of the electric wire; and a tip-side crimping portion being spaced from the base portion and to be swaged to be electrically connected to a conductor core wire. The covering is extended inside a base-side opening portion of the tip-side crimping portion. The covering and the conductor core wire are to be fastened together at the base-side opening portion. The covering configured to isolate the conductor core wire located between the base-side crimping portion and the tip-side crimping portion from outside the terminal metal fitting.

3 Claims, 3 Drawing Sheets

(56) References Cited

U.S. PATENT DOCUMENTS

2015/0357722 A1* 12/2015 Sato ..... H01R 13/5216
439/877

* cited by examiner

TERMINAL WITH SEALING FEATURES FOR CRIMPING ON AN ELECTRIC WIRE

CROSS-REFERENCES TO RELATED APPLICATION(S)

This application is based on and claims priority from Japanese Patent Application No. 2018-130102 filed on Jul. 9, 2018, and the entire contents of which are incorporated herein by reference.

BACKGROUND

Field of the Invention

The present invention relates to a terminal-attached electric wire in which a terminal metal fitting is attached to an electric wire.

Description of Related Art

In recent years, terminal-attached electric wires in which a terminal metal fitting made of copper or a copper alloy is attached to an electric wire having a conductor core wire made of aluminum or an aluminum alloy (hereinafter referred to as an "aluminum electric wire") have come to be used in, for example, wire harnesses routed in a vehicle from the viewpoints of weight reduction etc.

Incidentally, in terminal-attached electric wires of the above kind, galvanic corrosion (dissimilar metal contact corrosion) may occur in such a manner that water existing between the core wire of an electric wire and a terminal metal fitting which are made of dissimilar metals turns to electrolyte. As is well known, galvanic corrosion occurs due to a difference between standard electrode potentials of dissimilar metals.

In view of the above, in one conventional terminal-attached electric wire using an aluminum electric wire, a barrel portion of a terminal metal fitting is provided with a water stop sealing member, whereby the entire exposed portion, on which the barrel portion is crimped, of the conductor core wire is isolated from the outside. With this measure, galvanic corrosion of the exposed portion of the conductor core wire is suppressed and the reliability of the electrical connection between the terminal metal fitting and the conductor core wire can be kept high for a long time (refer to Patent document 1, for example).

As for details of the above terminal-attached electric wire, refer to JP 5,940,198 B.

SUMMARY

However, in the above conventional terminal-attached electric wire, in actual mass production of terminal-attached electric wires, it is required to attach a sealing member to the barrel portion of each terminal metal fitting while positioning the sealing member so as not to cause positional deviation etc., which makes it difficult to increase the productivity of terminal-attached electric wires. As such, the above conventional terminal-attached electric wire has room for improvement in terms of actual manufacture though it can keep the reliability of the electrical connection high.

An object of the invention is therefore to provide a terminal-attached electric wire capable of attaining both of high productivity and keeping of high reliability of the electrical connection.

Embodiments of the present invention provide the following items (1) to (3):

(1) A terminal-attached electric wire comprising:
- an electric wire; and
- a terminal metal fitting attached to the electric wire,
- the terminal metal fitting having:
  - a barrel portion to be crimped on a conductor core wire exposed from the electric wire; and
  - a contact portion to be connected to a counterpart terminal,
  - the barrel portion having: a base portion swaged to a cover body of the electric wire; and a tip portion being spaced from the base portion and swaged to be electrically connected to the conductor core wire,
  - the cover body being extended inside a base-side opening portion of the tip portion, the cover body and the conductor core wire being fastened together at the base-side opening portion, and the cover body isolating the conductor core wire located between the base portion and the tip portion from outside.

(2) The terminal-attached electric wire according to the item (1), wherein
- the barrel portion has, at the base-side opening portion of the tip portion, a through portion penetrating through the tip portion to allow the cover body to be viewable via the through portion.

(3) The terminal-attached electric wire according to the item (1) or the item (2), wherein
- an end portion of the conductor core wire is exposed from a tip-side opening portion of the barrel portion and extends away from the barrel portion.

According to first aspect of the invention, relating to the item (1), the base portion and the tip portion which constitute the barrel portion are spaced from each other. The base portion is crimped onto the cover body of the electric wire and the tip portion is crimped onto the conductor core wire of the electric wire so as to be electrically connected to it. Around the base-side opening portion of the tip portion, the cover body of the electric wire and the conductor core wire are fastened together with a portion of the cover body set inside the base-side opening portion. As a result, the conductor core wire is covered with the cover body, that is, no part of the conductor core wire is exposed, between the tip portion and the base portion of the barrel portion. Furthermore, since the portion of the cover body is fastened by the base-side opening portion of the tip portion 45 of the barrel portion, the portion of the cover body which is made of a resin is deformed so as to seal the gap between the barrel portion and the conductor core wire. Thus, entrance of water through the base-side opening portion of the tip portions can be suppressed. As a result, although a complete water stop cannot be attained for the entire exposed portion of the conductor core wire, a water stop can be attained properly between the tip portions and the base portion and around the base-side opening portion of the tip portion, whereby the function of the terminal-attached electric wire can be kept effective.

As such, the terminal-attached electric wire having the above configuration exhibits practical water stop performance though it is not provided with a water stop sealing member as used in the conventional terminal-attached electric wire. Furthermore, the crimping of the terminal metal fitting onto the electric wire does not require any special technique and can employ a conventional one. As a result, the terminal-attached electric wire having the above configuration can attain both of high productivity and keeping of high reliability of the electrical connection.

According to second aspect of the invention, relating to the item (2), since the through portion is formed so as to penetrate though the tip portion of the barrel portion in its thickness direction, the position of the end of the cover body can easily be recognized visually when, for example, the barrel portion is crimped. This makes it possible to increase the productivity of the terminal-attached electric wire further. There are no particular limitations on the form of the through portion which penetrate through the tip portion of the barrel portion in its thickness direction; it includes a cut, a through-hole, a slit, etc.

According to third aspect of the invention, relating to the item (3), since the end portion of the conductor core wire is exposed from the barrel portion, when the conductor core wire is corroded by galvanic corrosion (mentioned above), the end portion which is exposed from the barrel portion is corroded preferentially to the portion covered with the barrel portion. That is, since the corrosion proceeds gradually from the end of the conductor core wire, the corrosion of the portion covered with the barrel portion can be delayed by a time it takes for the end portion, exposed from the barrel portion, of the conductor core wire to corrode. In other words, the corrosion of the portion, in contact with (i.e., located inside) the barrel portion, of the conductor core wire can be delayed by causing the portion, exposed form the barrel portion, of the conductor core wire to corrode sacrificially.

The invention makes it possible to provide a terminal-attached electric wire capable of attaining both of high productivity and keeping of high reliability of the electrical connection.

Several aspects of the invention have been described briefly above. The further details of the invention will be made clearer if the following description is read through with reference to the accompanying drawings.

DETAILED DESCRIPTION

Embodiment

Figure 1A:
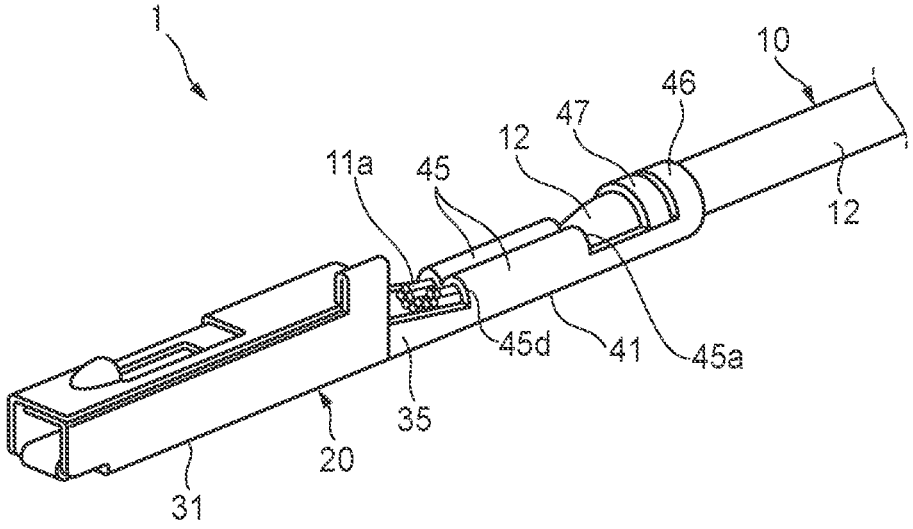
FIGS. 1A and 1B are a perspective view and a plan view, respectively, of a terminal-attached electric wire according to an embodiment.

A terminal-attached electric wire 1 according to an embodiment of the present invention in which a terminal metal fitting 20 is attached to an electric wire 10 will be hereinafter described with reference to the drawings. In the following, for convenience of description, in the axial direction (fitting direction) of the terminal metal fitting 20, the side of fitting with a counterpart terminal (not shown), that is, the left side in FIGS. 1A and 1B, 2, and 3, will be referred to as a tip side (front side) and the side opposite to it, that is, the right side in FIGS. 1A and 1B, 2, and 3, will be referred to as a base side (rear side). Furthermore, the top side and the bottom side are defined as seen in FIGS. 1A and 1B, 2, and 3.

As shown in FIGS. 1A and 1B, 2, and 3, the terminal metal fitting 20 is crimped on an end portion of the electric wire 10 and thereby electrically connected to a conductor core wire 11 of the electric wire 10. The electric wire 10 and the terminal metal fitting 20 constitute the terminal-attached electric wire 1. For example, the terminal-attached electric wire 1 serves as part of a wire harness that is routed in a vehicle, such as an automobile.

The electric wire 10 is an insulated electric wire having the conductor core wire 11 and a resin covering 12 which covers the conductor core wire 11. The conductor core wire 11 is formed by twisting together plural element wires made of aluminum or an aluminum alloy. Since the conductor core wire 11 of the electric wire 10 is made of aluminum or an aluminum alloy, the terminal-attached electric wire 1 is made lighter and hence the wire harness that includes the terminal-attached electric wire 1 is also made lighter. The light terminal-attached electric wire 1 is suitably used, in particular, in vehicles that employ a number of wire harnesses such as electric vehicles and hybrid vehicles.

The terminal metal fitting 20 has, on the tip side, a contact portion 31 to be connected to the counterpart terminal (not shown) and, on the base side, a barrel portion 41 to be connected to the conductor core wire 11 of the electric wire 10. The contact portion 31 and the barrel portion 41 are connected to each other by a link portion 35.

The terminal metal fitting 20 is formed by performing press working (punching and bending) on a metal plate (plate-like body). The terminal metal fitting 20 is made of a different metal material than the conductor core wire 11 is which is made of aluminum or an aluminum alloy. More specifically, the terminal metal fitting 20 is formed using, as a base material, a metal plate (plate-like body) made of copper or a copper alloy, for example.

To, for example, suppress corrosion of the conductor core wire 11 of the electric wire 10 (i.e., to increase its corrosion resistance), it is preferable to perform plating on the terminal metal fitting 20 after a base metal plate is pressed and before crimping onto the electric wire 10. In the embodiment, before being crimped onto the electric wire 10, the terminal metal fitting 20 is subjected to tin (Sn) plating. More specifically, a plating layer containing tin is formed on the front surface, the back surface, and the side surfaces formed by the press working.

Figure 1B:
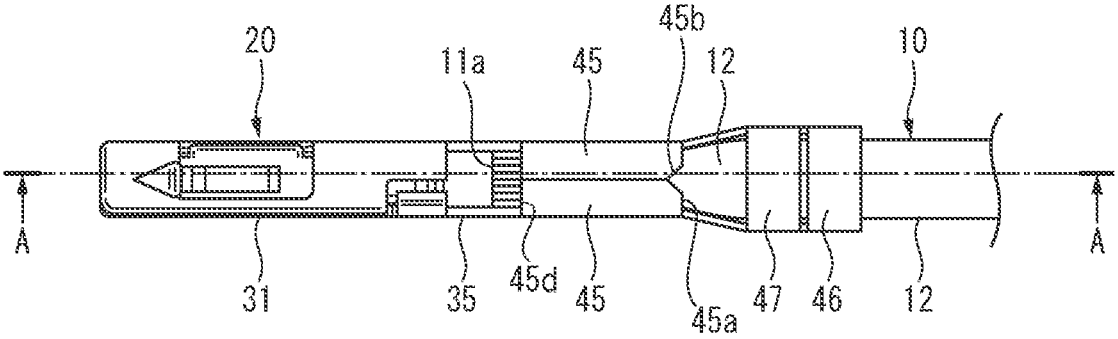

After being subjected to the surface treatment, the contact portion 31 is formed so as to be shaped like a rectangular pipe having an open tip portion (see FIGS. 1A and 1B). The counterpart terminal (not shown) is inserted into the open portion of the contact portion 31, whereby the contact portion 31 and the counterpart terminal are electrically connected to each other.

As shown in FIGS. 1A and 1B, the barrel portion 41 is crimped onto an end portion of the electric wire 10 and thereby electrically connected to the conductor core wire 11. To enable such crimping and connection, the barrel portion 41 has a pair of crimping pieces 45 to be crimped and connected to the conductor core wire 11 and crimping pieces 46 and 47 to be crimped on the covering 12. In the following, the pair of crimping pieces 45 will also be referred to as "tip-side crimping portions 45" because they are located at a tip-side position in the barrel portion 41. Since the crimping pieces 46 and 47 are located at a base-side position in the barrel portion 41, they will also be referred to as "base-side crimping portions 46 and 47." The tip-side crimping portions 45 are spaced from the base-side crimping portions 46 and 47 in the axial direction of the electric wire 10.

More specifically, as shown in FIGS. 1A and 1B, the tip-side crimping portions 45 are crimped onto the end portion of the electric wire 10 by swaging them in such a manner that their extension ends confront each other. In the embodiment, an end portion 11*a* of the conductor core wire 11 of the electric wire 10 is located on the tip side of a tip-side opening portion 45*d* of the tip-side crimping portions 45 having a tubular shape and is exposed from the barrel portion 41.

Figure 2:
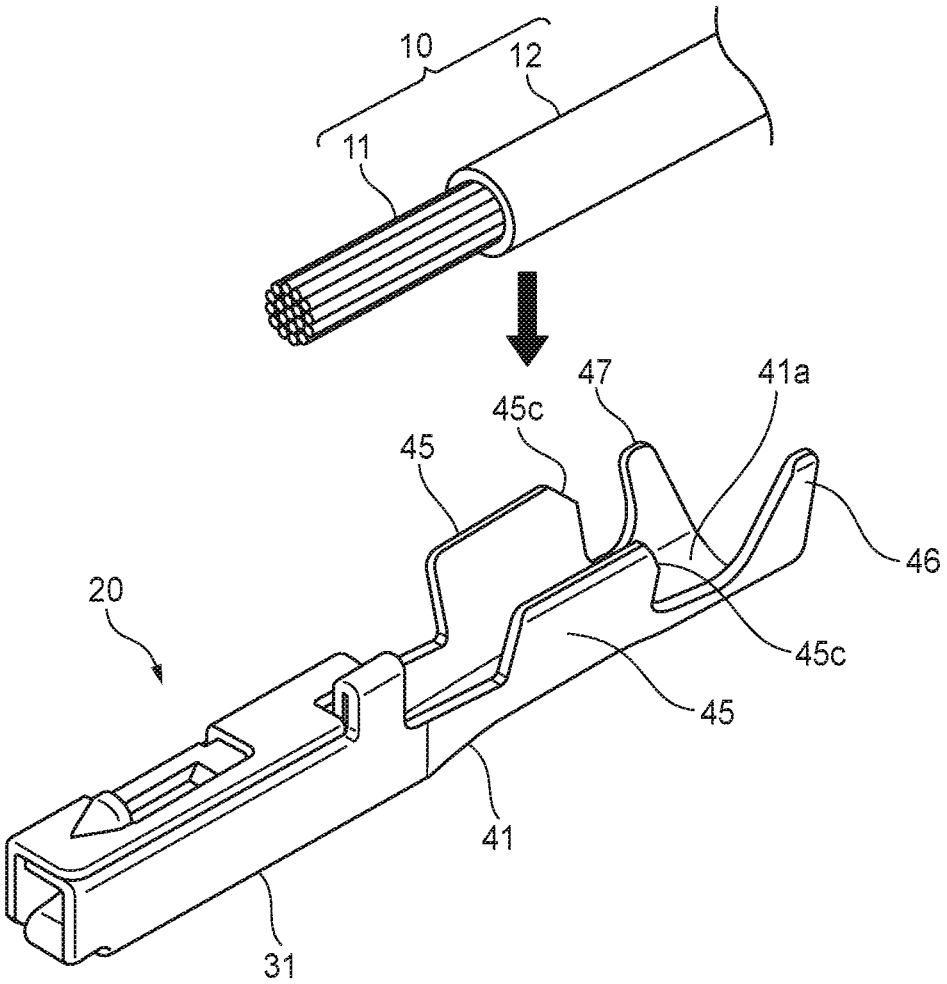
FIG. 2 is a perspective view showing how an electric wire is attached to a terminal metal fitting.

As shown in FIG. 2, the top surface (inner surface) of the barrel portion 41 before crimping is a mounting surface 41*a* on which the end portion of the electric wire 10 is to be mounted. The pair of crimping pieces 45 and the crimping pieces 46 and 47 are swaged using, for example, a known crimping machine in a state that electric wire 10 is mounted on the mounting surface 41*a* in such a manner that terminal portions of the conductor core wire 11 and the covering 12 are interposed between the pair of crimping pieces 45 and portions, distant from the terminal portion, of the covering 12 is interposed between the crimping pieces 46 and 47.

Figure 3:
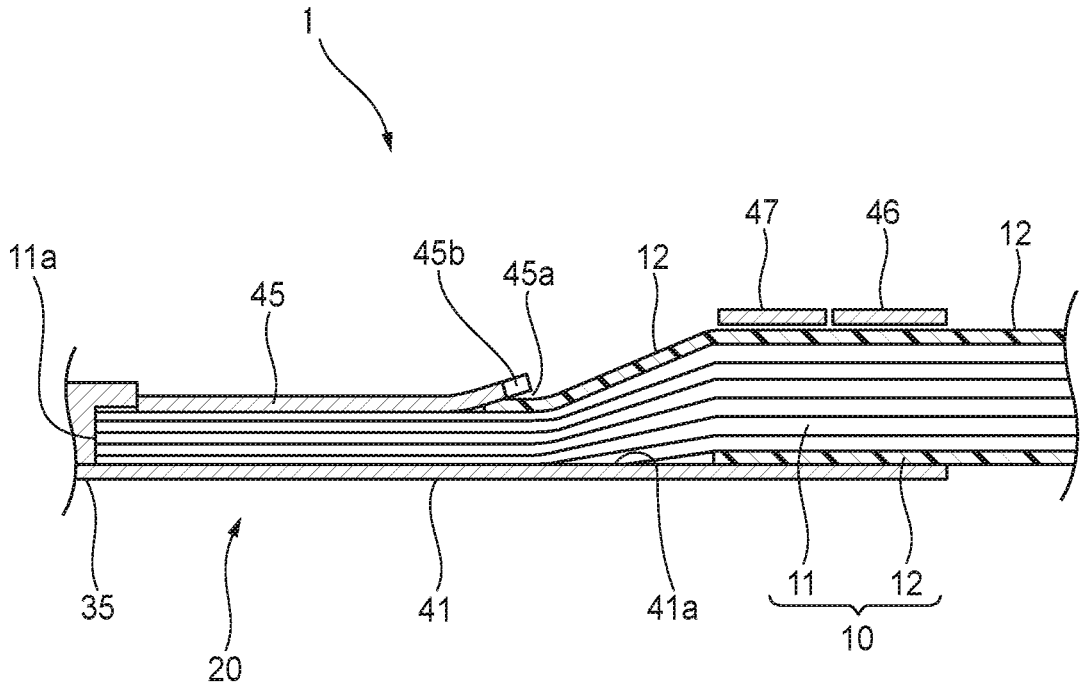
FIG. 3 is an A-A sectional view of FIG. 1B.

As a result, as shown in FIGS. 1A and 1B and FIG. 3, the tip-side crimping portions 45 are crimped onto the terminal portions of the conductor core wire 11 and the covering 12 and the base-side crimping portions 46 and 47 are crimped onto the covering 12. In particular, around a base-side opening portion 45*a* of the tip-side crimping portions 45, the covering 12 of the electric wire 10 and the conductor core wire 11 are fastened together with a portion of the covering 12 set inside the base-side opening portion 45*a*. As a result, the conductor core wire 11 is covered with the covering 12, that is, no part of the conductor core wire 11 is exposed, between the tip-side crimping portions 45 and the base-side crimping portions 46 and 47. Furthermore, since the covering 12 is fastened with the portion of the covering 12 set inside the base-side opening portion 45*a*, around the base-side opening portion 45*a*, the covering 12 is deformed so as to seal the gap between the tip-side crimping portions 45 and the conductor core wire 11.

Furthermore, as shown in FIG. 1B, the base-side opening portion 45*a* of the tip-side crimping portions 45 of the barrel portion 41 is formed with a through portion 45*b* which penetrates through the tip-side crimping portions 45 in the thickness direction to make the portion of the covering 12 viewable. In the embodiment, the through portion 45*b* is a V-shaped cut formed by cutting original pieces of the base-side opening portion 45*a* toward the tip side. As shown in FIG. 2, the cut-shaped through portion 45*b* is formed by chamfering corner portions 45*c* of extension end portions of the pair of crimping pieces 45 before crimping.

As described above, in the terminal-attached electric wire 1 according to the embodiment of the invention, the base-side crimping portions 46 and 47 are spaced from the tip-side crimping portions 45 (the tip-side crimping portions 45 and the base-side crimping portions 46 and 47 constitute the barrel portion 41). The base-side crimping portions 46 and 47 are crimped onto the covering 12 of the electric wire 10 and the tip-side crimping portions 45 are crimped onto the conductor core wire 11 of the electric wire 10 so as to be electrically connected to it.

Around the base-side opening portion 45*a* of the tip-side crimping portions 45, the covering 12 of the electric wire 10 and the conductor core wire 11 are fastened together with a portion of the covering 12 set inside the base-side opening portion 45*a*. As a result, the conductor core wire 11 is covered with the covering 12, that is, no part of the conductor core wire 11 is exposed, between the tip-side crimping portions 45 and the base-side portions of the barrel portion 41.

Furthermore, since the portion of the covering 12 is fastened by the base-side opening portion 45*a* of the tip-side crimping portions 45 of the barrel portion 41, the portion of the covering 12 is deformed so as to seal the gap between the barrel portion 41 and the conductor core wire 11. Thus, entrance of water through the base-side opening portion 45*a* of the tip-side crimping portions 45 can be suppressed.

With the above structures, although a complete water stop cannot be attained for the entire exposed portion of the conductor core wire 11, a water stop can be attained properly between the tip-side crimping portions 45 and the base-side crimping portions 46 and 47 and around the base-side opening portion 45*a* of the barrel portion 41, whereby the function of the terminal-attached electric wire 1 can be kept effective.

Furthermore, since the through portion 45*b* is formed so as to penetrate though the tip-side crimping portions 45 of the barrel portion 41 in their thickness direction, the position of the end of the covering 12 can easily be recognized visually when, for example, the barrel portion 41 is crimped. This makes it possible to increase the productivity of the terminal-attached electric wire 1 further. In addition, since as in the embodiment the through portion 45*b* is shaped like a cut, the water stop performance of the base-side opening portion 45*a* can be enhanced further for the reason described later.

More specifically, if the extension end portions of the pair of crimping pieces 45 bite into the covering 12 too deep when they are crimped onto the conductor core wire 11 and the cover 12 so as to confront each other, there may occur damage that they penetrate through the covering 12 in its thickness direction. In contrast, because of the presence of the cut-shaped through portion 45*b*, such deep biting is not prone to occur in the vicinity of the base-side opening portion 45*a* and occurrence of such damage in the covering 12 can be suppressed or prevented. As a result, entrance of water through a damaged portion of the covering 12 around the base-side opening portion 45*a* can be suppressed or prevented and the water stop performance can be enhanced around the base-side opening portion 45*a*. As such, the cut-shaped through portion 45*b* has an effect of enhancing the water stop performance around the base-side opening portion 45*a* in addition to increasing the visibility of the position of the end of the covering 12.

Still further, since the end portion 11*a* of the conductor core wire 11 is exposed from the barrel portion 41, when the conductor core wire 11 is corroded by galvanic corrosion (mentioned above), the end portion 11*a* which is exposed from the barrel portion 41 is corroded preferentially to the portion covered with the barrel portion 41. That is, since the corrosion proceeds gradually from the end of the conductor core wire 11, the corrosion of the portion covered with the barrel portion 41 can be delayed by a time it takes for the end portion 11*a* exposed from the barrel portion 41 to corrode. In other words, the corrosion of the portion, in contact with (i.e., located inside) the barrel portion 41, of the conductor core wire 11 can be delayed by causing the portion, exposed form the barrel portion 41, of the conductor core wire 11 to corrode sacrificially.

As described above, the terminal-attached electric wire 1 exhibits practical water stop performance though it is not provided with a water stop sealing member as used in the conventional terminal-attached electric wire. Furthermore, the crimping of the terminal metal fitting 20 onto the electric wire 10 does not require any special technique and can employ a conventional one. As a result, the terminal-attached electric wire 1 can attain both of high productivity and keeping of high reliability of the electrical connection.

Other Embodiments

The invention is not limited to the above embodiment and various modifications, improvements, etc. can be made as appropriate within the scope of the invention. The materials, shapes, sets of dimensions, numbers, locations, etc. of the respective constituent elements of the above embodiment are not limited to those disclosed but can be determined in desired manners as long as the invention can be implemented.

For example, in the embodiment, the base-side opening portion 45*a* of the tip-side crimping portions 45 of the barrel portion 41 is formed with the cut-shaped through portion 45*b* (see FIG. 1B). However, from the viewpoint of increasing the visibility of the covering 12, it suffices that the through portion 45*b* penetrate through the tip-side crimping portions 45 in their thickness direction; the through portion 45*b* is not limited to a cut. For example, the through portion 45*b* may be a through-hole or a slit. To enhance the water stop performance around the base-side opening portion 45*a*, it suffices that the through portion 45*b* be shaped so as to suppress excessive biting of the tip-side crimping portions 45 into the covering 12 around the base-side opening portion 45*a*; the shape of the through portion 45*b* is not limited to a V shape. For example, the through portion 45*b* may be a U-shaped cut or a portion in which the corner portions (45*c*) (see FIG. 2) of the tip-side crimping portions 45 are folded in such directions as to go away from the covering 12.

Features of the above-described terminal-attached electric wire 1 according to the embodiment of the invention will be summarized below concisely in the form of items [1] to [3]:

[1] A terminal-attached electric wire (1) comprising:

an electric wire (10); and a terminal metal fitting (20) attached to the electric wire (10), the terminal metal fitting (20) having:

a barrel portion (41) to be crimped on a conductor core wire (11) exposed from the electric wire (10); and a contact portion (31) to be connected to a counterpart terminal, the barrel portion (41) having: a base portion (46, 47) swaged to a cover body (12) of the electric wire (10); and a tip portion (45) being spaced from the base portion (46, 47) and swaged to be electrically connected to the conductor core wire (11), the cover body being extended inside a base-side opening portion (45*a*) of the tip portion (45), the cover body (12) and the conductor core wire (11) being fastened together at the base-side opening portion (45*a*), and the cover body (12) isolating the conductor core wire (11) located between the base portion (46, 47) and the tip portion (45) from outside.

[2] The terminal-attached electric wire (1) according to the item [1], wherein the barrel portion (41) has, at the base-side opening portion (45*a*) of the tip portion (45), a through portion (45*b*) penetrating through the tip portion (45) to allow the cover body (12) to be viewable via the through portion (45*b*).

[3] The terminal-attached electric wire (1) according to the item [1] or the item [2], wherein an end portion (11*a*) of the conductor core wire (11) is exposed from a tip-side opening portion of the barrel portion (41) and extends away from the barrel portion (41).

REFERENCE SIGNS LIST

1: Terminal-attached electric wire
10: Electric wire
11: Conductor core wire
12: Covering (cover body)
20: Terminal metal fitting
31: Contact portion
41: Barrel portion
45: Tip-side crimping portion (tip portion)
45*a*: Base-side opening portion
46, 47: Base-side crimping portion (base portion)

The invention claimed is:

1. A terminal metal fitting for attaching to an electric wire comprising:

a barrel portion disposed on a base side of the terminal metal fitting configured to be crimped on a conductor core wire exposed from the electric wire; and a contact portion disposed on a tip side of the terminal metal fitting configured to be connected to a counterpart terminal, the barrel portion having: a base-side crimping portion configured to be swaged to a covering of the electric wire; and a tip-side crimping portion being spaced from the base-side crimping portion and configured to be swaged to be electrically connected to the conductor core wire, the covering being extended inside a base-side opening portion of the tip-side crimping portion, the covering and the conductor core wire configured to be fastened together at the base-side opening portion, and the covering configured to isolate the conductor core wire to be located between the base-side crimping portion and the tip-side crimping portion from outside the terminal metal fitting.

2. The terminal metal fitting according to claim 1, wherein the barrel portion has, at the base-side opening portion of the tip-side crimping portion, a through portion penetrating through the tip-side crimping portion to allow the covering to be viewable via the through portion.

3. The terminal metal fitting according to claim 1, wherein an end portion of the conductor core wire is configured to be exposed from a tip-side opening portion of the barrel portion and extends away from the barrel portion.

* * * * *